US006732489B1

(12) United States Patent
Hawley

(10) Patent No.: US 6,732,489 B1
(45) Date of Patent: May 11, 2004

(54) CARTON FLAP FOLDING METHOD AND APPARATUS

(75) Inventor: Corey E. Hawley, Austell, GA (US)

(73) Assignee: Graphic Packing International Inc., Marietta, GA (US)

( * ) Notice: Subject to any disclaimer, the term of this patent is extended or adjusted under 35 U.S.C. 154(b) by 0 days.

(21) Appl. No.: 09/451,050

(22) Filed: Nov. 30, 1999

Related U.S. Application Data

(60) Provisional application No. 60/111,578, filed on Dec. 9, 1998.

(51) Int. Cl.[7] ..... B65B 21/00; B65B 21/24

(52) U.S. Cl. ..... 53/398; 53/48.8

(58) Field of Search ..... 53/398, 334, 387.2, 53/48.6, 48.7, 48.8, 48.9; 493/163, 165, 180, 182, 183, 184, 436, 452, 453

(56) References Cited

U.S. PATENT DOCUMENTS 3,908,332 A * 9/1975 Ebbinghaus et al. ..... 53/48.7
4,160,353 A * 7/1979 Ganz ..... 53/393
4,291,518 A * 9/1981 Johnson ..... 53/491
4,791,774 A * 12/1988 Calvert ..... 53/377.5
5,154,039 A * 10/1992 De Guglielmo ..... 53/398
5,653,084 A * 8/1997 Mueller ..... 53/48.7
5,673,536 A * 10/1997 Easter et al. ..... 53/398
5,681,253 A * 10/1997 Owen et al. ..... 493/165

* cited by examiner

*Primary Examiner*—Rinaldi I. Rada
*Assistant Examiner*—John Paradiso

(57) ABSTRACT

A carton flap folding method and apparatus utilizes a flap folding assembly, which includes a tucker wheel for folding gussets on the carton. More specifically, the tucker wheel may engage a gusset within a flap as a carton proceeds downstream within a article grouping and packaging machine. The tucker wheel may tuck all panel gussets inwardly as carton side panels are moved downwardly by plows within the packaging machine.

17 Claims, 5 Drawing Sheets

CARTON FLAP FOLDING METHOD AND APPARATUS

RELATED APPLICATIONS

Applicant hereby claims the benefit of priority to provisional application Ser. No. 60/111,578, filed on Dec. 9, 1998, and entitled "Carton Flap Folding Method and Apparatus."

FIELD OF THE INVENTION

This invention generally relates to a carton flap folding assembly and methods for use in a continuous motion packaging machine for packaging articles such as, for example, beverage containers. This invention also includes the methods of folding carton flaps. This invention is particularly suitable for folding the gussets of a carton flap of a wrap-around type carton as the carton is being wrapped around a preformed bottle group in a continuous motion packaging machine. The present invention also includes a packaging machine utilizing the improved carton flap folding methods and apparatus disclosed.

BACKGROUND OF THE INVENTION

Continuous motion article packaging machines, such as those used in the beverage packaging industry are well known, and various types of packaging machines are constructed to accomplish the packaging of articles into different types of cartons. One such machine enables articles, such as glass or plastic bottles, to be packaged in a wrap-around paperboard carton. For example, Riverwood International Corporation's Marksman™ series of packaging machines are specifically designed to package beverage containers into a wrap-around type carton. These various types of Marksman™ packaging machines include sequential work stations in which the cartons and/or the bottle groups are placed in a proper orientation or configuration, and the packaging process is accomplished in high speed, continuous fashion. These known machines include a carton feeding magazine or feeder that selects a single paperboard carton blank and transfers that carton blank to an infeed area where the carton is moved, still in its blank or unfolded state into position to be placed over a preformed bottle group. The carton blank is moved downstream being supported in a horizontal position by an upstream plow. As the carton blank continues to be moved through the machine, its front side panels are plowed downwardly to fold around the bottle group as the bottle group continues to move in a downstream direction, through the machine. As the carton is continuously and sequentially folded around the bottle group, the opposing end sections of the carton blank, which become the bottom portions of the completely folded carton, come in contact with one another and typically are glued or locked into position to complete the preformed carton. During the process of folding the carton blank around the preformed bottle group, however, there is typically other carton flap folding steps which must take place simultaneously with the carton side flap folding, in order to result in a completely folded carton around the bottle group.

The carton includes flaps that, in their folded state, comprise panels which not only assist in holding the bottle group in place in a fully formed carton, but also provide a surface onto which graphics, such as advertising, can be placed. These flaps are commonly referred to as advertising panels or "ad panels." Such ad panels are well known and include a central, flat section and opposed side webs or gussets that effectively connect the central section to the carton blank at its edges. The central section also is connected to the carton blank along a third side edge.

It also is known in the art that these gussets must be folded inwardly, toward the interior portion of the carton as the carton side panels are folded around the bottle group, in order to permit the ad panels to be properly oriented vertically in a filly formed carton. Therefore, two gussets are associated with each ad panel, with the first ad panel being positioned along the upper, leading side of the carton and a second ad panel being positioned along the upper, trailing side of a carton as the carton passes in the downstream or feed direction of the machine. The gussets include a fold line which facilitates the folding of the ad panel downwardly and the folding of the respective gusset inwardly. The necessity to fold the gussets inwardly, however, also necessitates that a separate apparatus be included along with the packaging machine at the folding workstation to affirmatively contact the gusset and fold the gusset inwardly along its fold line. Known prior gusset folding devices include-stationary plows which are placed in the feed path of the carton at the position of the gusset fold line, which simply push the gusset inwardly as the carton is affirmatively moved in its downstream direction, to fold the gussets attached to the leading ad panel. It has proved more difficult, however, to fold the gussets of the trailing ad panel, considering that the trailing ad panel is moving in the downstream direction along with the carton blank away from a trailing or upstream folding device. This required the use of moving components to track the downstream motion of the carton blank for a specified distance, and articulate projections such as fingers against the gussets to move the trailing gussets inwardly.

It is also known in the art to provide overhead paddles on a moving belt that tracks the carton blank movement to fold the ad panels into a horizontal position, as the known gusset folding devices push the gussets inwardly toward the interior of the carton. These articulating gusset folding devices include tucking fingers that are carried by a chain driven around an outer camming surface or cam track. An inner cam track is utilized to articulate the folding fingers at the appropriate position in order to move the fingers against the trailing gussets as the trailing gussets move in the downstream direction as the carton side flaps are folded downwardly. This entire device typically is in the form of a cassette, which can be placed into proper position, and is associated with a particular sized bottle group and machine pitch. If the packaging machine was run on a different pitch, requiring a different bottle group configuration and a different carton, the cassette could be removed and replaced with another cassette specifically designed for that machine pitch.

These gusset-folding cassettes, however, include a number of disadvantages. First, the gusset-folding cassettes are extremely heavy and difficult to install, thus increasing change-over time between various product runs which lowers productivity. Second, the gusset-folding cassettes have a large number of parts, making them difficult and expensive to build and maintain. Additionally, due to the complex nature of the gusset-folding cassettes, malfunctions sometimes occur when running the continuous packaging machine a high rate of speed, which creates machine downtime, lowers productivity and increases manufacturing costs.

SUMMARY OF THE INVENTION

The present invention relates to a continuous motion article packaging machine of the type having an article transport conveyor for moving a pre-configured group of articles through the machine and for packaging the article group into a paperboard carton. More specifically, the present invention relates to a carton folding assembly, which includes a tucker wheel for tucking a gusset which connects the folding flap to main sections of the carton. In the preferred embodiment, the tucker wheel is vertically oriented just above a main transport conveyor within the machine and includes first and second engagement surfaces. The preferred embodiment includes an assembly mechanically attached to the tucker wheel for rotating the tucker wheel so that the first engaging surface contacts the first portion of the carton and a second engaging surface contacts a second portion of the carton.

In the preferred embodiment, a circumferential edge portion of the tucker wheel actually comprises the first engagement surface. Additionally, in the preferred embodiment of the present invention, the tucker wheel includes a notch formed into the outer periphery of the tucker wheel. The notch is comprised of a depressed portion defined by a space between a leading tooth and a trailing tooth. In the preferred embodiment, the trailing tooth comprises the second engaging surface.

In a preferred embodiment of the present invention the tucker wheel assembly may also include a tucker wheel arm having a first end for rotatably supporting the tucker wheel and a second end which is rotatably fastened to a portion of the article packaging machine frame, so that the tucker wheel arm may rotate into a first position to engage the carton flaps within cartons translating downstream the packaging machine. Additionally, the tucker wheel arm may then rotate into a second position to effectively remove the carton flap folding assembly away from cartons translating downstream. This feature allows the removal of the tucker wheel assembly for machine maintenance or product changeover. The carton flap folding assembly may also include a height adjustment mechanism for allowing an adjustment of a height of the tucker wheel with respect to the conveyor for accommodating articles of varying heights. In a preferred embodiment, the tucker wheel circumferal edge is located just below the planar surface of the carton so as to engage a carton flap after it is folded into a vertical position below a planar surface of the carton. In a preferred embodiment of the present invention, the machine may also include an upper conveyor for conveying carton blanks from a carton magazine to the carton flap folding assembly. The upper conveyor may include paddles for contacting the carton flaps and for moving the carton flaps into a substantially perpendicular orientation with respect to a horizontal axis of the carton. Additionally, the first and second engagement surfaces may then contact and the fold gussets beneath the carton. More specifically, the first engagement surface on the tucker wheel contacts gussets attached to a first flap on a leading edge portion of a carton progressing through the machine, and the second engagement surface comprises a trailing edge tooth defined by the notch for contacting gussets attached to the second flap on a trailing portion of the carton as it progresses through the machine. Finally, the invention may also include a pair of tucker wheels separated by a predetermined space for simultaneously contacting gussets on lateral edges of the carton flaps.

The present invention also relates to an improved method for folding a carton flap within a paperboard carton prior to wrapping the paperboard carton around a pre-configured group of articles wherein the method comprises the steps of disposing the carton tucking wheel adjacent to a transportant conveyor, wherein the carton tucking wheel includes first and second engaging surfaces, engaging a paperboard carton at a first portion by the first engaging surface to fold a portion of the carton away from the first engaging surface and engaging a second portion of the carton by the second engaging surface to fold the second portion of the carton away from the second engaging surface.

In a preferred embodiment of the present invention the method may also include the step of engaging the first carton portion with a substantially circumferential edge portion of the tucker wheel. Additionally, the improved method may include the step of engaging the second portion of the carton with a trailing tooth to disposed on the tucker wheel. Finally, the inventive method may also include the step of utilizing a pair of tucker wheels to contact gussets disposed on lateral portions of each folding flap within a carton.

These and other features of the present invention will become apparent upon reading the following specification when taken in conjunction with the accompanying drawings.

DETAILED DESCRIPTION OF THE PREFERRED EMBODIMENTS

Figure 1:
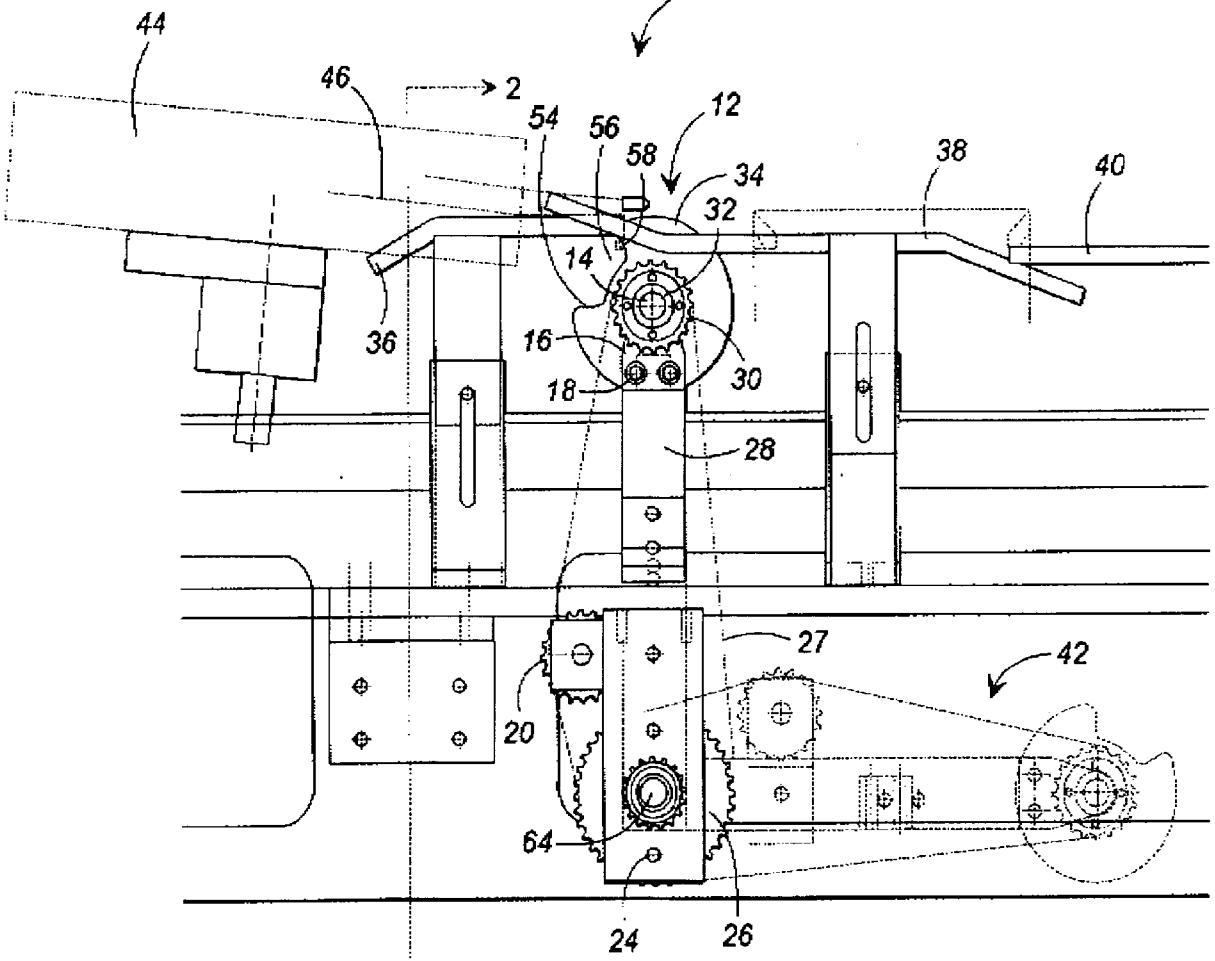
FIG. 1 is a side view of a portion of a continuous motion article-packaging machine, which includes a flap folding assembly in accordance with the present invention.

FIG. 1 illustrates a portion of a continuous motion article packaging machine 10 of the present invention which is specifically designed to fold wrap-around carton blanks around a preformed bottle group 11, shown in dashed lines. The packaging machine 10 includes a carton blank feeding section having a carton feeder, a carton blank transfer section that includes carton feed chutes, a bottle infeed section, a bottle group forming section, a carton folding section or carton wrap-around section that wraps around and locks the cartons around the respective bottle groups, and a transport section that moves the bottles and the completed bottle group and carton assembly in a downstream direction to the outlet section of the machine. The carton folding section also includes an overhead flap folding assembly that pushes the ad panels approximately 90° from a horizontal orientation, into a vertical-orientation. This carton folding section also includes a carton flap or gusset folding assembly that moves the respective four gussets of the carton ad panel inwardly, toward the interior of the carton as the carton side flaps are folded downwardly.

Figure 2:
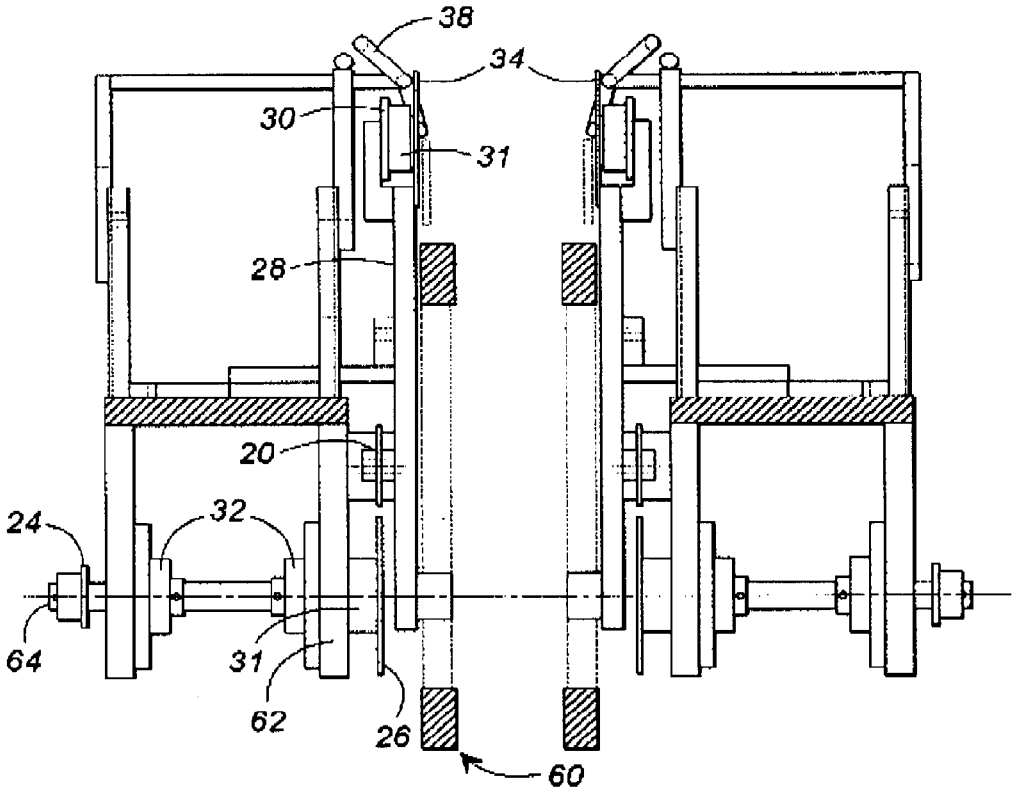
FIG. 2 is a front view of the carton flap folding assembly made accordance with the present invention.

As shown in FIGS. 1 and 2, gusset folding assembly 12 includes a tucker wheel which is vertically oriented and placed in the path of feed of the bottle group and carton blank 46. In the packaging machine, two such carton folder or gusset folder assemblies 12 are positioned, one along each side of the main transport conveyor 60, which conveyor moves in a downstream direction from the carton infeed section towards the outfeed end of the packaging machine. The tucker wheel 34 is generally circular in shape, and includes an outer periphery or circumference and a notched or cut-out section 56. The notched section 56 defines two teeth along opposing sides, a leading tooth 54, located downstream, and a trailing tooth 58, located upstream, so that an open area or space is defined between these teeth. As shown in FIG. 1, the tucker wheel turns in a clockwise direction of arrow A, toward the downfeed direction of conveyor. The tucker wheel is mounted to an upper drive sprocket 30 so that the tucker wheel is oriented vertically. The upper drive sprocket 30 includes a hub 31. The tucker wheel 12 is attached to the hub 31 by any suitable means such as pins or bolts. Upper drive sprocket 30 is supported by a bracket 16 that is attached to an upstanding tucker arm 28. The tucker arm 28 is attached to the packaging machine frame, and is adjustable vertically (upwardly and downwardly) and horizontally (inwardly toward the conveyor or outwardly away from the conveyor) by the adjustment of the packaging machine accessory rail. It is well known in the art to provide adjustable accessory rails along the sides of the packaging machines for the vertical and horizontal adjustment of various components attached to the accessory rail. Otherwise, the tucker arm can be mounted to support brackets as to be vertically and horizontally adjustable. A second or lower drive sprocket 26 is positioned directly below upper drive sprocket 30. Lower drive sprocket 26 is supported by an arm located below the accessory rail. A chain or belt 27 passes around these sprockets. A tension sprocket 20 is positioned just above the lower sprocket 26 and is adjustable in the upstream and in the downstream direction to provide tension to the chain 27. A third drive sprocket 24 is attached to the lower sprocket 26 through a shaft 64. The third drive sprocket 24 is driven by a chain or belt to a fourth sprocket (not shown) which is connected to a gear box (not shown). The gear box is driven through a shaft that is connected to the main conveyor transport sprockets so that as the main conveyor 60 is driven, the lower drive sprocket 26 likewise is driven. Therefore, as the third sprocket 24 is driven from the main conveyor or transport drives, the lower and upper drive sprockets likewise are driven, which drives the tucker wheel 34 in a clockwise direction of arrow A as shown in FIG. 1.

Also as shown in FIG. 1 in phantom lines, the tucker wheel assembly can be pivoted clockwise into a horizontal position 42 for storage in instances in which the tucker wheel 34 is not needed, or to provide better access to the carton folding area. The transport conveyor 60 includes upstanding lugs (not shown) that move the bottle group through the machine, and is positioned below the tucker wheel 34.

Figure 3:
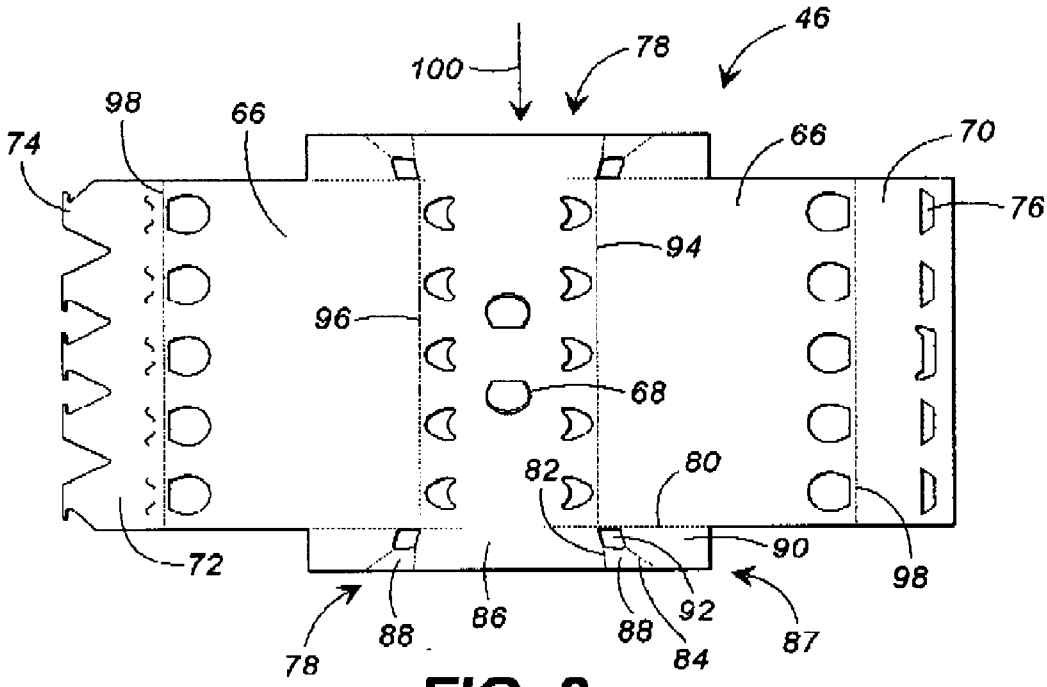
FIG. 3 is a top plan view of a typical carton blank, which is utilized in conjunction with the present invention.

FIG. 3 illustrates a top plan view of a typical carton used in conjunction with the carton flap folding apparatus in accordance with the present invention. Arrow 100 indicates the direction by which the carton proceeds through the packaging machine 10. Typically speaking, the carton 46 includes a top panel 68, which is separated from side panel 66 by fold lines 94 and 96. The carton 46 also includes bottom panel 72 separated from panel 66 by fold 98 and bottom panel 70 separate from side panel 66 by fold line 98. Bottom panel 70 includes apertures 76, which receive tabs 74 after carton 46 is wrapped around a group of articles by machine 10. Carton 46 also includes carton flaps, or side flaps 78, which each include a center panel 86 for stabilizing a group of bottles and for receiving printing for advertising purposes. Each one of the side flaps 78 also includes apertures 92 and fold lines 82, 84, and 80. As is explained in greater detail below, the machine 10 folds the entire flap 78 into a perpendicular orientation with respect to side panel 66 and end panels 70 and 72 while the carton progresses in a downstream manner. Subsequent operations of the tucker wheel assembly contact the gussets 87, which are made up of sections 88 and 90, to bring fold line 82 into contact with fold line 80 when center panel 86 is disposed perpendicular with respected top panel 68, and when side panels 66 are folded down and around the bottles, to create a neat appearance for the interface between panel 86 and panel 66. Additionally, the gusset 87 insures that center section 86 remains stationery and snug with respect the side panel 66.

Figure 4A:
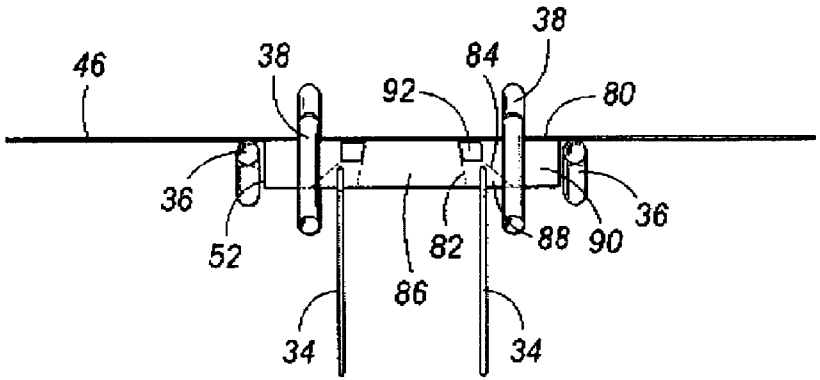
FIG. 4A is a downstream end view schematic illustration of a carton progressing through the carton flap folding assembly.
Figure 4B:
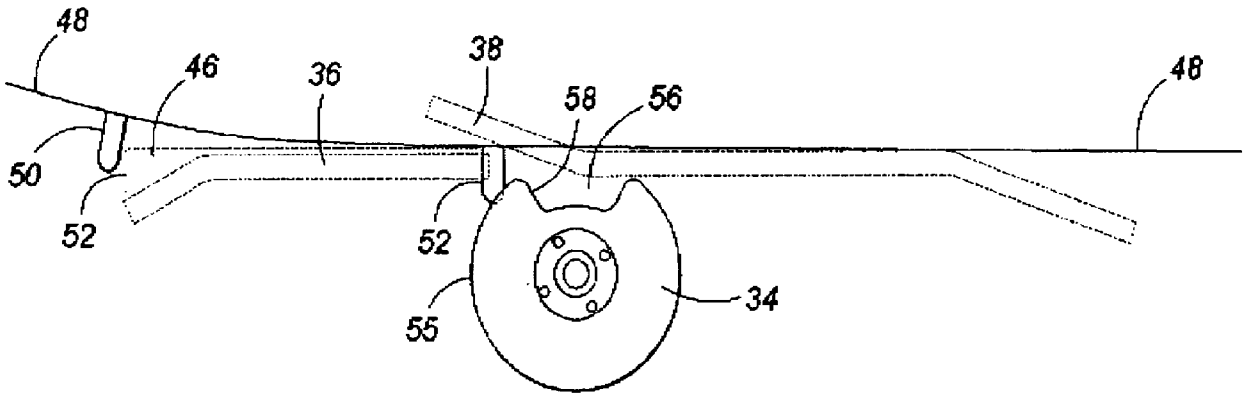
FIG. 4B is a side view of a carton progressing through the flap folding assembly.
Figure 5A:
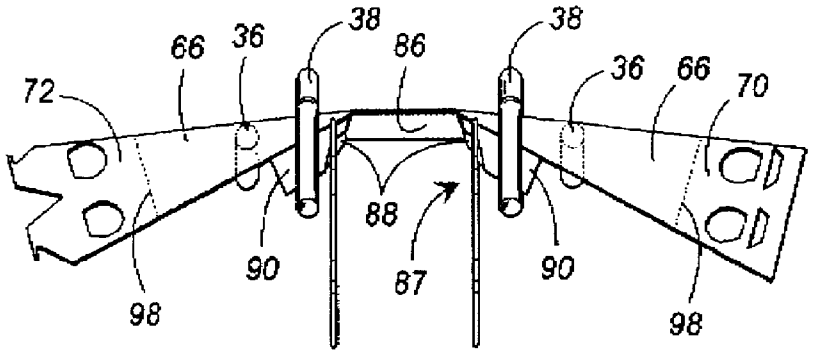
FIG. 5A is a downstream end view schematic illustration of a carton progressing through the carton folding apparatus.
Figure 5B:
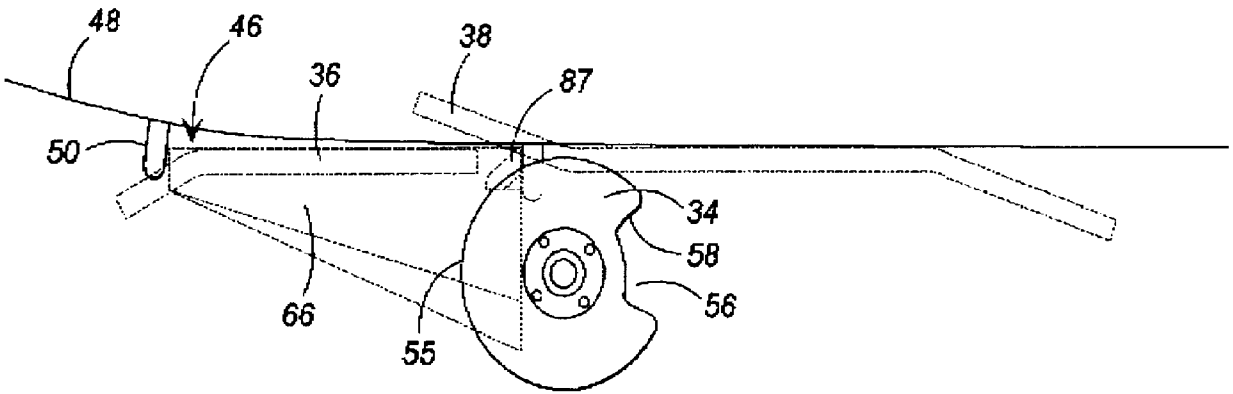
FIG. 5B is a side view of the carton progressing through the carton folding apparatus.
Figure 6:
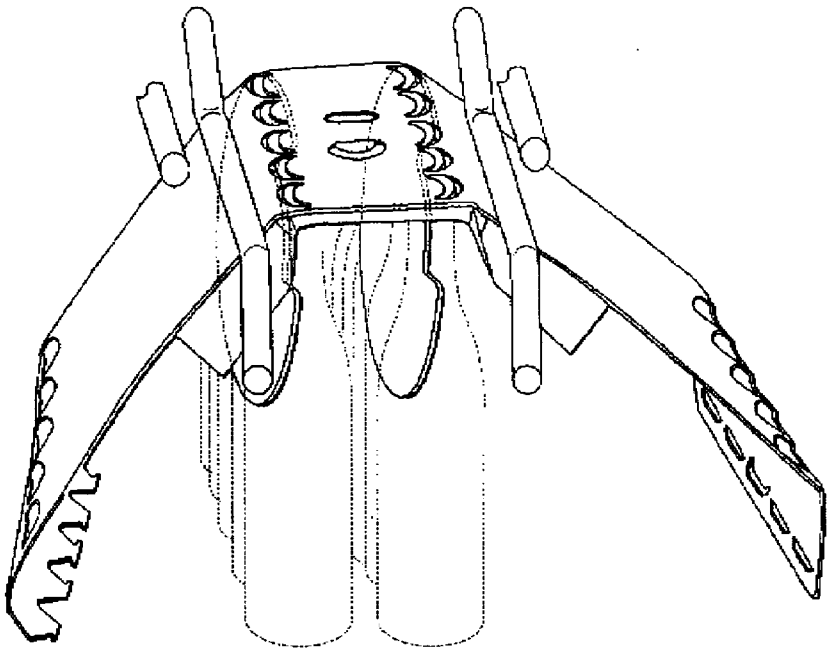
FIG. 6 is a perspective view of the carton progressing through the carton flap folding apparatus.

FIGS. 4A through 7 schematically illustrate the sequential movement of the carton blank 46 through the packaging machine 10, and specifically through the gusset folding assembly 12. The figures also show the position of the tucker wheel 34 relative to the carton 46 as the carton 46 moves through the machine along the path of travel. FIGS. 4A and 5A illustrate end views of the tucker wheels plowing a carton, while FIGS. 4B and 5B show a side view of these elements, and also include the ad panel folding assembly and folding paddles. FIG. 4A corresponds to FIG. 4B, FIG. 5A corresponds to FIG. 5B. FIG. 6 illustrates a perspective view of the carton 46 progressing through machine IQ.

The tucker wheels 34 rotate in the direction of feed, or the downstream direction of the transport conveyor as the carton moves through the packaging machine. The rotational speed of the tucker wheels 34 is such that the tucker wheels 34 rotate two times as a carton 46 moves past the tucker wheels 34. This ensures that the tucker wheels 34 will be in the proper position with respect to the carton 46 as the tucker wheels 34 fold the gussets 87 inwardly, toward the interior of the carton 46. FIGS. 4A and 4B show a carton blank 46 between the upper and lower plows, with the carton approaching the tucker wheel 34. As is illustrated in FIG. 4B, paddles 50 on upper conveyor 48 fold the ad panels into a vertical position with respect to other positions of the carton blank 46. Paddles 50 pass between the tucker wheels 34 as the downstream ad panel 52 moves into contact with tucker wheel outer edge 55. FIG. 4A illustrates downstream end view corresponding to FIG. 4A. FIG. 4A illustrates the tucker wheels 34 immediately prior to engagement with first and second gusset sections 88 and 90, on either side of center section 86, so as to begin the under-folding process of gussets 88, whereby fold lines 82 and 80 contact one another further downstream.

Figure 7:
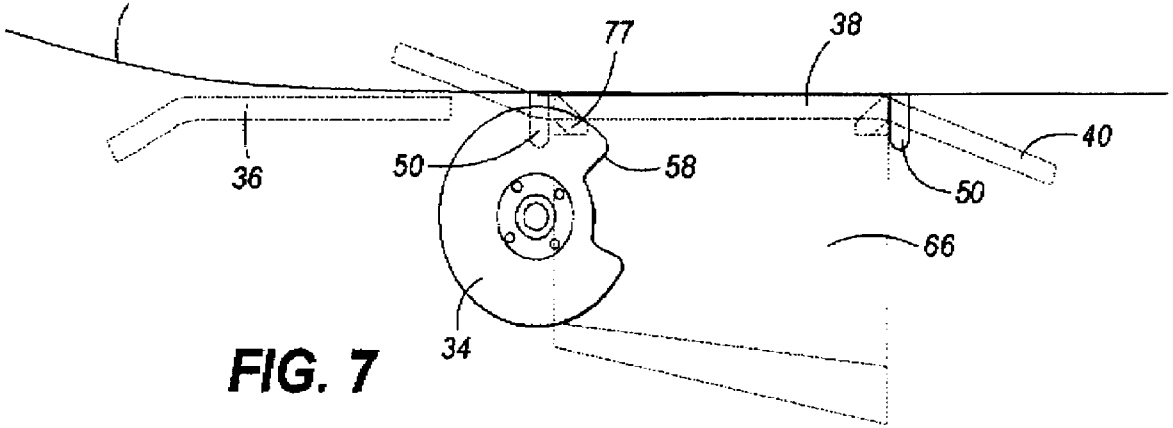
FIG. 7 is a side view of a carton, which has fully progressed through a carton flap folding apparatus in accordance with the present invention.

Referring now to FIGS. 5A and 5B, outer periphery 55 tucker wheels 34 now begins to move gussets 87 as closing plow 38 begins to fold side panels 66 in a downward manner, while opening plow 36 retains an upstream portion of the carton 46 in an open position. In FIGS. 5A and 5B, the carton has contacted the outer periphery 55 of the tucker wheels 34 behind the trailing tooth so that the gussets of the front ad panel are being folded inwardly. This continues through FIG. 7, with the tucker wheels approaching their second revolution for this cycle, that is, for folding the gussets of one carton. As shown in FIG. 7, the leading tooth of the tucker wheel had just cleared the rear ad panel, preferably without contacting the carton at this position. FIG. 7 shows the carton in a position progressively downstream with the tucker wheel rotated further clockwise so that the rear ad panel of the carton is within the notched or cut out area of the tucker wheel. In FIG. 7, the tucker wheel is shown coming in contact with the rear ad panel gussets by the rear or trailing tooth.

It should be noted that the opening plow 36 is designed to hold either the entire carton 46 or a portion of the carton in the fully open or horizontal position upstream of the tucker wheel 34, while the plow 38 is located downstream and designed to progressively fold the carton side panels 66 downwardly. It is well known in the art to control the orientation of the leading and trailing edges of the carton side panels as the gussets 87 are folded inwardly, so as to avoid problems in carton folding, for example, a bowing out of the carton in certain areas.

As is illustrated in FIGS. 5A and 5B, the tucking wheel 34 is utilized so that outer edge 55 of the tucker wheel adjacent to the trailing tucker wheel tooth 58 forms a first engaging surface that is placed in the path of the gussets, and specifically the fold line of the gussets, as the carton is progressively moved in a downstream direction, so that the outer periphery of the tucker wheel 58 serves as a plow to push the leading ad panel gussets 87 inwardly toward the interior of the carton. As the carton side flaps are held in a downward position by paddles 50, the partially folded gussets 87 are held into place, or partially tucked. The opening plows 36 in the upstream position keep the rear of the carton flaps in a horizontal position so that it does not bow outwardly when the front gussets 87 are being tucked to the interior of the carton. As the carton 46 progresses through the packaging machine 10, the tucker wheel 34 rotates between one and one-half and two revolutions until the trailing tooth 58, which forms a second engaging surface, is positioned to turn into the trailing gussets 87 and push those gussets inwardly as the carton moves in the downstream direction, as is illustrated in FIGS. 5 and 7. In this manner, all four gussets 87 are tucked inwardly as the carton side panels continue to be moved downwardly around the carton to an extent that the gussets are held between the carton side panels and the articles, such as beverage containers, as illustrated in FIG. 6. The final closing plow 40 also serves to keep the carton closed and to keep it folded once the gussets have been folded by the tucker wheel. The notch 56 in the tucker wheel 34 allows the center section 86 to be positioned within the notch 56 of the wheel 34 as the rear center panel 86 is moved over the tucker wheel, so as not to interfere with the rear center panel 86. Importantly, the horizontal velocity component of the tucker wheel 34, at its outer circumference, is greater than the velocity of the carton 46 moving through the machine 10. Finally, FIG. 7 illustrates the carton 46 after trailing tooth 58 has completely tucked the trailing gusset 87, and as the carton 46 moves toward the final closing plow 40.

The present invention works well on a single pitch machine such as a 12½ inch pitch, but the present invention works equally well on a multiple pitch machine. In the case of a multiple pitch machine, the speed of the tucker wheel 34 will have to be adjusted in accordance with the carton size and the speed of the carton transport through the machine, so that the carton properly contacts the circumference of the tucker wheels to tuck the leading ad panel gusset 87 in while allowing the tucker wheel to rotate twice in the full cycle. This allows the trailing tooth 58 to center section 86 to rotate around and contact the gussets 87 to tuck those gussets 87 inwardly as the rear of the carton passes over the tucker wheel.

Also, as known in the art, the plows or guides of the machine can be vertically and horizontally adjusted to properly close the carton sidewalls at the appropriate positions.

While the preferred embodiments have been illustrated and described above, it is recognized that variations may be made with respect to the features and components of this invention. Therefore, while the invention has been disclosed in preferred forms only, it will be obvious to those skilled in the art that many additions, deletions and modifications may be made therein without departing from the spirit and scope of this invention, that no undue limits should be imposed thereon except to set forth in the following claims. For example, Applicant contemplates that the tucker wheel may comprise virtually any shape, which is necessary to accomplish the objectives of the present invention.

I claim:

1. In a continuous motion article packaging machine having a transport conveyor for moving a preconfigured bottle group through a carton folding section of the machine for packaging the bottle group into a paperboard carton, said carton including a top panel, carton flaps disposed adjacent the top panel, and first and second side panels disposed adjacent the top panel, and wherein the carton flaps each include a center panel and foldable gussets for maintaining peripheral portions of the center panel in contact with peripheral edges of the side panels when the carton is in a wrapped position around the preconfigured bottle group, the improvement comprising a method for folding a carton flap comprising the steps of:

disposing a carton tucker wheel of a carton flap folding assembly adjacent to said transport conveyor, said carton tucker wheel including a first engaging surface and a second engaging surface;

conveying carton blanks to the carton flap folding assembly;

engaging the carton with an overhead flap folding assembly and orienting the carton flaps from a horizontal orientation into a substantially perpendicular orientation with respect to a horizontal axis of the carton, as the bottle group moves through the carton folding section;

engaging first gussets of the paperboard carton by said first engaging surface to fold said first gusset of the carton away from said first engaging surface;

engaging second gussets of the carton by said second engaging surface to fold said second gussets of said carton away from said second engaging surface, thereby contacting and folding the gussets beneath the carton with the tucker wheel to maintain contact between the center panel peripheral edges with the side panel peripheral edges when the carton side panels are folded around the bottle group.

2. The method of claim 1, wherein the step of engaging the first carton portion comprises the step of:

engaging the first carton portion with a substantially circumferential edge portion of the tucker wheel.

3. The method of claim 2 comprising the further step of:

orienting the circumferential edge portion of the tucker wheel below a planar surface of the carton.

4. The method of claim 1 comprising the further step of engaging the second carton portion with a trailing tooth disposed on the tucker wheel.

5. The method of claim 1, wherein the article packaging machine includes a tucker wheel arm having a first end rotatably supporting the tucker wheel and a second end rotatably fastened to the article packaging machine, the method comprising the further steps of:

rotating the tucker wheel into a first position to engage carton flaps within cartons translating downstream within the packaging machine; and rotating the tucker wheel arm into a second position to effectively remove the carton flap folding assembly away from cartons translating downstream.

6. The method of claim 1 comprising the further step of:

adjusting a height of the tucker wheel with respect to the transport conveyor for accommodating articles of varying height.

7. The method of claim 1 wherein the carton includes two carton flaps attached to leading and trailing portions of the carton, respectively, and disposed between the flaps and the side panels, said method comprising the further step of:

contacting gussets attached to the leading flap with the tucker wheel peripheral edge; and contacting gussets attached the trailing flap with a tooth defined by a notch said tucker wheel outer peripheral edge.

8. The method of claim 1, wherein the carton includes a top panel and first and second side panels disposed adjacent the top panel, and wherein the flaps each include a center panel having first and second foldable gussets on first and second peripheral edges of the center panel, respectively, for the maintaining edges of the center panel in contact with peripheral edges of the side panels when the carton is in a wrapped position around the preconfigured group of articles, said method comprising the further steps of:

engaging the first gusset and second gussets with first and second tucker wheels, respectively.

9. The method claim 8 comprising the further step of:

allowing the center panel to pass between said first and second tucker wheels while said tucker wheels engage the gussets.

10. In a continuous motion article packaging machine of the type having an article transport conveyor for moving a preconfigured article group through the machine and packaging the article group into a paperboard carton, said carton including a top panel, carton flaps disposed adjacent the top panel, and first and second side panels disposed adjacent the top panel, and wherein the carton flaps each include a center panel and foldable gussets for maintaining peripheral portions of the center panel in contact with peripheral edges of the side panels when the carton is in a wrapped position around the preconfigured group of articles, the improvement comprising:

a carton flap folding assembly comprising a tucker wheel having a first engaging surface and a second engaging surface;

said tucker wheel being oriented vertically and disposed adjacent to said transport conveyor;

a drive assembly attached to said tucker wheel for rotating said tucker wheel so that said first engaging surface contacts a first portion of the carton and said second engaging surface contacts a second portion of said carton;

an upper conveyor for conveying carton blanks from a carton blank magazine to the carton flap folding assembly;

upper conveyor paddles for contacting the carton flaps and for moving the carton flaps into a substantially perpendicular orientation with respect to a horizontal axis of the carton, and wherein said first and second engaging surfaces of said tucker wheel contact and fold the gussets beneath the carton for maintaining contact between the center panel peripheral edges with the side panel peripheral edges when the carton side panels are folded around the group of articles.

11. The article packaging machine of claim 10, wherein the first engaging surface comprises:

a substantially circumferential edge portion of said tucker wheel.

12. The article packaging machine of claim 11 wherein said substantially circumferential edge portion is oriented below a planar surface of the carton.

13. The article packaging machine of claim 10 further comprising:

a notch formed into an outer periphery of said tucker wheel, wherein said notch includes a depressed portion defined by a space between a leading edge tooth and a trailing edge tooth, wherein said trailing edge tooth comprises said second engaging surface.

14. The article packaging machine of claim 10, further comprising:

a tucker wheel arm including a first, end for rotatably supporting the tucker wheel; and a second end rotatably fastened to a portion of the article packaging machine, wherein the tucker wheel arm may rotate into a first position to engage carton flaps within cartons translating downstream within the packaging machine, and wherein the tucker wheel arm may rotate into a second position to effectively remove the carton flap folding assembly away from cartons translating downstream.

15. The article packaging machine of claim 10, further comprising:

a height adjustment mechanism for allowing a height adjustment of said tucker wheel with respect to said article transport conveyor for accommodating articles of varying height.

16. The article packaging machine of claim 10 wherein the carton includes two carton flaps attached to leading and trailing portions of the carton, respectively, and disposed between the flaps and the side panels, wherein:

said first engagement surface comprises a tucker wheel peripheral edge for contacting gussets attached to the first flap; and said second engagement surface comprises a trailing edge tooth defined by a notch on said tucker wheel outer peripheral edge for contacting gussets attached to the second flap.

17. A carton flap folding assembly for a continuous motion packaging machine for packaging an article group within a carton of the type having a top panel, first and second side panels, and carton flaps each having a center panel and a series of foldable gussets for engaging and maintaining each center panel of each carton flap in contact with the side panels, comprising:

a tucker wheel oriented vertically and being adjustably mounted adjacent a path of travel of the article group to accommodate packaging of articles of varying heights, said tucker wheel having a first engaging surface and a second engaging surface;

a variable drive assembly communicating with and driving said tucker wheel at a rate sufficient to cause said first engaging surface to contact a first portion of the carton and said second engaging surface to contact a second portion of the carton; and an upper conveyor for conveying a carton blank into a position for wrapping about the article group, said upper conveyor having a series of upper conveyor paddles adapted to engage and urge the carton flaps from a horizontal orientation to a vertical orientation adjacent the article group, wherein said first and second engaging surfaces of said tucker wheel engage and fold the gussets of the carton into engagement to secure the center flaps and side panels about the article group.

* * * * *